US008944298B2

(12) United States Patent
Hickey et al.

(10) Patent No.: US 8,944,298 B2
(45) Date of Patent: Feb. 3, 2015

(54) GARMENT HANGER

(75) Inventors: Teresa Hickey, Park Orchards (AU); Brendan Hickey, Park Orchards (AU); Craig Pattison, Park Orchards (AU); Donna Pattison, Park Orchards (AU)

(73) Assignee: Hickson Hangers Pty Ltd, Mitcham (AU)

( * ) Notice: Subject to any disclaimer, the term of this patent is extended or adjusted under 35 U.S.C. 154(b) by 0 days.

(21) Appl. No.: 13/704,625

(22) PCT Filed: Jun. 17, 2011

(86) PCT No.: PCT/AU2011/000728

§ 371 (c)(1),
(2), (4) Date: Dec. 16, 2012

(87) PCT Pub. No.: WO2011/156863

PCT Pub. Date: Dec. 22, 2011

(65) Prior Publication Data

US 2013/0087587 A1 Apr. 11, 2013

(30) Foreign Application Priority Data

Jun. 18, 2010 (AU) ..... 2010902663

(51) Int. Cl.
*A47G 25/28* (2006.01)
*A47G 25/18* (2006.01)
(Continued)

(52) U.S. Cl.
CPC ..... *A47G 25/183* (2013.01); *A47G 25/18* (2013.01); *A47G 2025/1492* (2013.01)
USPC ..... 223/88; 211/85.3

(58) Field of Classification Search
CPC ..... A47G 25/02; A47G 25/14; A47G 25/16; A47G 25/18; A47G 25/36; A47G 25/40; A47G 25/48; A47G 25/482; A47G 25/486; A47G 25/4076; A47F 5/0884; A47F 5/0006; A47F 7/19; A47F 7/22; A45C 3/00
USPC ..... 223/85–93, 69, 95, 96; 211/113, 116, 211/119, 123, 85.3, 85.15, 89.01, 85.29, 211/118; D6/317, 315, 320, 323, 325, 326, D6/328; 248/316.5, 316.7, 339, 610; 383/39; D8/372
See application file for complete search history.

(56) References Cited

U.S. PATENT DOCUMENTS 609,743 A * 8/1898 Heaton ..... 223/88
1,421,709 A 7/1922 Nelson
(Continued)

FOREIGN PATENT DOCUMENTS

CA 2529691 A1 6/2007
CN 201480997 5/2010
(Continued)

*Primary Examiner* — Ismael Izaguirre
(74) *Attorney, Agent, or Firm* — Darren Gardner

(57) ABSTRACT

The present invention relates to a method and device for display and/or storage of garments or other items of apparel such as skirts, dresses, ties, scarves, hats, jewelery and the like. In particular, the present invention provides a garment hanger comprising at least one rung member, wherein the at least one rung member comprises: first attachment formations disposed on the outer periphery of the rung member and adapted to receive a first portion of a first garment and; second attachment formations disposed within the outer periphery of the rung member and adapted to receive a second portion of a second garment.

18 Claims, 5 Drawing Sheets

(51) Int. Cl.

| | |
|---|---|
| *A47F 7/19* | (2006.01) |
| *A41D 27/22* | (2006.01) |
| *A47G 25/14* | (2006.01) |

(56) References Cited

U.S. PATENT DOCUMENTS

| | | | | | |
|---|---|---|---|---|---|
| 1,607,749 | A | * | 11/1926 | Rice | 223/88 |
| 2,058,217 | A | * | 10/1936 | Dixon | 211/119 |
| D167,986 | S | * | 10/1952 | Jonaitis | D6/315 |
| 2,640,598 | A | * | 6/1953 | Peacock | 211/89.01 |
| 2,644,589 | A | * | 7/1953 | Levine | 211/118 |
| 3,054,538 | A | | 9/1962 | Rubin | |
| 3,352,430 | A | * | 11/1967 | McAtee | 211/119 |
| 3,993,205 | A | * | 11/1976 | Pilchard | 211/116 |
| 4,136,784 | A | * | 1/1979 | Knobel et al. | 211/119 |
| D327,581 | S | * | 7/1992 | Fildan | D6/326 |
| 5,303,855 | A | * | 4/1994 | Veale | 223/85 |
| 5,645,200 | A | * | 7/1997 | McDowell et al. | 223/89 |
| 6,758,378 | B2 | * | 7/2004 | Carmichael | 223/85 |
| 2004/0159686 | A1 | * | 8/2004 | Huang | 223/85 |
| 2005/0242135 | A1 | | 11/2005 | Lam | |
| 2006/0226179 | A1 | * | 10/2006 | Hsu | 223/85 |
| 2008/0000935 | A1 | * | 1/2008 | Austin | 223/85 |
| 2008/0308511 | A1 | | 12/2008 | Ruelas | |
| 2009/0078726 | A1 | * | 3/2009 | Boulet et al. | 223/85 |
| 2009/0078728 | A1 | | 3/2009 | Snyder | |
| 2010/0051655 | A1 | | 3/2010 | Gouldson | |

FOREIGN PATENT DOCUMENTS

| | | | |
|---|---|---|---|
| GB | 704306 | A | 11/1955 |
| JP | 3126127 | U | 10/2006 |
| WO | 2009/131394 | A2 | 10/2009 |

* cited by examiner

GARMENT HANGER

RELATED APPLICATIONS

This application claims priority to Australian Provisional Patent Application No. 2010902663 in the name of Hickson Hangers Pty Ltd, which was filed on 18 Jun. 2010, entitled "Garment Hanger" and the specification thereof is incorporated herein by reference in its entirety and for all purposes.

FIELD OF INVENTION

The present invention relates to the field of display and/or storage of garments or other items of apparel such as skirts, dresses, ties, scarves, hats and the like. In particular, the present invention relates to a means for hanging garments. It will be convenient to hereinafter describe the invention in relation to a modification for a conventional clothes hanger that can be hung from a horizontal bar or rod in a wardrobe or closet, however it should be appreciated that the present invention is not limited to that use, only.

BACKGROUND ART

Throughout this specification the use of the word "inventor" in singular form may be taken as reference to one (singular) inventor or more than one (plural) inventor of the present invention.

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Generally, incorrect storage of form-fitting or delicate garments can reduce the lifespan of certain products, for example, underwire bras. Furthermore, storage of garments such as, lingerie, sleepwear, sports singlets and bathers can occupy relatively large amounts of space. Also, selection of garments can be made difficult due to storage in drawers or on shelves.

Hanging of sleeveless garments may be difficult as the angle of the hanger allows for movement of the garment off the hanger. Retrieval of a garment may be difficult if more than one garment is hanging on a hanger. Moreover, sets of garments are not easily stored together and it is difficult, if not impossible, to provide easy access or visibility in display for sets of garments.

Delicate underwear garments and garments that are difficult to hang have traditionally been stored in drawers, in boxes or, on shelves. Hangers have been designed with 'peg' attachments to overcome this. Whilst it provided an alternative to drawer storage, the problem with the 'peg' hanger is that garments cannot easily be hung or retrieved without taking the hanger from the rail and placing it on a flat surface. Also, with frequent use, the pegs may snap off. Visibility of the desired garment(s) is also limited with this method. Storing delicate garments in boxes in drawers reduces visibility for selection and increases storage space required. Garments tend to tangle and slip off when stored on a conventional hanger with the hook, making the retrieval and hanging process cumbersome. Such hangers certainly do not allow for the storage of sets of garments. Of course the conventional hooked hanger can provide reduced storage space and improve visibility for selection, but does not allow for the storage of underwear sets or swimwear, for instance. If a conventional or peg hanger is used to store sets of garments, then when retrieving a single garment item, it may lead to tangling the other garments or having to take them off to retrieve the desired article. Furthermore, it is difficult to retrieve the desired article without having to take the hanger off the rail that supports the hanger.

US 2008/0308511 in the name of Angel D. Ruelas addresses a problem pertaining specifically to bras being typically stored in drawers or hung from door knobs or conventional coat hangers. Drawer storage is noted to be often damaging to the padding or under wires, and door knob or coat hanger storage is noted as being unsightly and unorganised. The solution offered by Ruelas is a device specifically for hanging bras and comprises the following features:

a conventional fixed coat hanger type hook centrally attached to the top of a horizontal beam;

a vertical support attached to the bottom of the horizontal beam extending downward;

additional horizontal beams distributed along the vertical support (as needed);

hooks, smaller than the centrally attached top hook, are spaced along each of the horizontal beams allowing for storage of one bra per hook.

However, Ruelas does not address the issues of hanging sleeveless garments or hanging sets of garments with easy access or visibility in display.

Another prior art device is disclosed by US 2009/0078728 (Snyder) and comprises a garment hanging system having a sheet secured to a clothes hanger by folding the sheet over the horizontal portion of a conventional hanger and securing itself with Velcro™ fastenings. Hooks are situated in the sheet for attaching garments thereto. The Snyder device however, is a complicated multi-component design and may be susceptible to having the sheet and fastenings collect dust, grime or become otherwise soiled and require similar cleaning as would other fabric items.

SUMMARY OF INVENTION

It is an object of the embodiments described herein to overcome or alleviate at least one of the above noted drawbacks of related art systems or to at least provide a useful alternative to related art systems.

In a first aspect of embodiments described herein there is provided a garment hanger comprising at least one rung member, wherein the at least one rung member comprises:

first attachment formations disposed on the outer periphery of the rung member and adapted to receive a first portion of a first garment and;

second attachment formations disposed within the outer periphery of the rung member and adapted to receive a second portion of a second garment.

Preferably, at least one of the attachment formations are disposed in the plane of the rung members.

Alternatively in preferred embodiments at least one of the attachment formations are disposed out of the plane of the rung members.

The attachment formations may be integrally formed with the rung member. Adjacent rung members may be integrally connected to each other. Alternatively, adjacent rung members may be hingedly connected to each other.

Preferably, at least one of the attachment formations and the rung members comprise a wire formation. Moreover, the attachment formations may comprise one or a combination of:

loop means;

hook means.

When used, preferred embodiments of the invention may be utilised for garments wherein the first garment and the second garment are one and the same kind of garment. Alternatively, the first garment and the second garment may be different garments together forming a set of garments.

In certain embodiments the first portion of a first garment comprises a strap portion of a sleeveless garment and the second portion of a second garment comprises a waist portion of one of:

panties;

a bikini bottom;

pants;

an underwear bottom;

a sleepwear bottom.

In one preferred embodiment, a supporting hook may be located on the topmost portion of the hanger for allowing the hanger to be hung from a supporting structure. The supporting hook is preferably adapted to swivel for allowing the hanger to be turned up to at least 90 degrees with respect to the hanger whilst hanging from the supporting structure.

In another aspect of embodiments described herein there is provided a method of displaying and/or storing a set of garments comprising the steps of:

attaching a first portion of a first garment of the set to a first attachment formation disposed on the outer periphery of a rung member adapted for hanging;

attaching a second portion of a second garment of the set to a second attachment portion disposed within the outer periphery of the rung member.

In yet a further aspect of embodiments described herein there is provided a method of, manufacturing a garment hanger comprising the steps of:

forming at least one rung member;

machine forming first attachment formations in the outer periphery of the rung member;

machine forming second attachment formations internally of the outer periphery of the rung member.

The step of forming at least one rung member may comprise wire forming. In one embodiment, the method further, comprises the step of welding rung portions together to form integral connections between adjacent rung members. Alternatively, articulated or folding connections may be provided, for example, the method may comprise the step of hinging the rung portions together to form hinged connections between rung members. As another means, primarily for adjusting the length of the hanger, the rungs may be clipped together with clip means that may be formed integrally with the rung members or as a separate clip to be attached in each instance.

Preferably, the method of manufacturing further comprises the step of coating portions of the hanger, wherein the coating comprises one or a combination of:

plastic coating;

polypropylene;

chrome;

powder coating;

coating with flocking material.

The rung members of preferred embodiments comprise one or a combination of:

wire;

solid plastic mould;

stainless steel;

bronze wire.

Persons skilled in the art would recognise that alternate materials, alone or in combination with the above materials, may be suited for forming the rung members.

Other aspects and preferred forms are disclosed in the specification and/or defined in the appended claims, forming apart of the description of the invention.

In essence, the present invention stems from the realization that hanging fragile garments such as bras rather than storing them in drawers limits the potential for them to be damaged as well as providing the user with a clear display for choosing outfits to wear. This, in turn, led to the realisation that incorporating first and second attachment means at relatively different positions upon rung members can provide for user friendly display and safe storage of sets of garments. A further realisation is that multiple rung members used in this fashion can provide for user friendly display and safe storage of a plurality of garments or sets of garments thus increasing wardrobe storage efficiency and/or display area efficiency.

The placement and shape of the side hooks or loops, for example, allow for easy access to hang and retrieve garments when the hanger is hanging or being held with one hand. The placement of the hooks also allows for the retrieval of garments without taking all garments off or tangling with other hanging garments. The optional formation of inside hooks that are out of the plane of the rung members can also contribute to ease of storage and display of sets of garments.

Advantages provided by the present invention comprise the following:

Preferred embodiments of the invention provide a product that allows for easy attachment and retrieval of garments;

Garments can be hung or retrieved while the hanger remains on a rail;

Garments are less likely to slip off;

Multiple delicate garments can be stored on one device, but it remains easy to retrieve a single garment without tangling or taking all other garments off the device;

Garments with 'cup' shapes such as bras, bathers, and tops with bra inserts, can be stored safely without crushing the garment's cups or twisting the garment onto itself and reducing the life of the garment;

Sets of lingerie, sleepwear and bikinis can be stored as a set using the loop and the hooks on the same rung;

Storage space for underwear, sleepwear, sportswear and swimwear is greatly reduced, and this also applies to other garments such as, for example, shoe string and spaghetti string tops, camisoles and dresses or the like, skirts, scarves and jewelery;

The preferred hanger embodiment can be produced in a range of colours to suit any decor and can be made in reduced dimensions to cater for children's wear;

Versatility of use is provided, such as for example, with the children's size or even smaller adult garments, the full size hanger can be used for smaller garments by utilising the inside hooks in place of the outside hooks.

The preferred hanger is also waterproof and can be hung in the bathroom or outside clothes line to receive washed or at least wet garments for drying;

In a preferred embodiment having a swivel top allows the hanger to be hung on a clothesline so garments can dry in their 'natural' position;

The swivel top also allows for the hanger to be turned at least up to 90 degrees with respect to the hanger per se whilst in its hanging position within the wardrobe allowing for easy loading and unloading of garments as well as selection of required garments;

The hanger of preferred embodiments of the invention can be used for a wider range of garment product than prior art hangers;

Hangers of preferred embodiments are an organisational tool that will, for instance, save women time when selecting lingerie garments while at the same time freeing up space in the wardrobe and drawers and contributing to a tidy look for the wardrobe along with the tidy display provided by the hanger;

Given the improved display properties of the preferred embodiments, the invention lends itself for use in commercial sales from lingerie outlets, swimwear outlets, and sporting outlets;

With respect to sets of garments, one hanger device of the present invention can provide storage for multiple garments and also provide easy access and visibility for garment selection;

It can also hang an entire outfit in as much as the hanger may be used to set out an entire outfit including necklace, belt, skirt, top etc ready for the next day.

The hinged or clipped rung sections of the hanger allow for each section to be folded up in a cascade effect for small storage and small point of sale display footprint.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

The inventor was led, in part, to the present invention by owning numerous bras that were ordinarily stored in drawers and became frustrated that she could not see clearly which one she wanted to wear on a particular day with a particular outfit. It was considered desirable if such garments could all hang in a wardrobe so they could clearly be seen, thus allowing for a more simplified process in choosing the particular garment required at the time. It was then considered desirable that if they were hung instead of stored in drawers it would also fix the problem of damage being sustained, which happens frequently when such garments are stored in a drawer.

Figure 1:
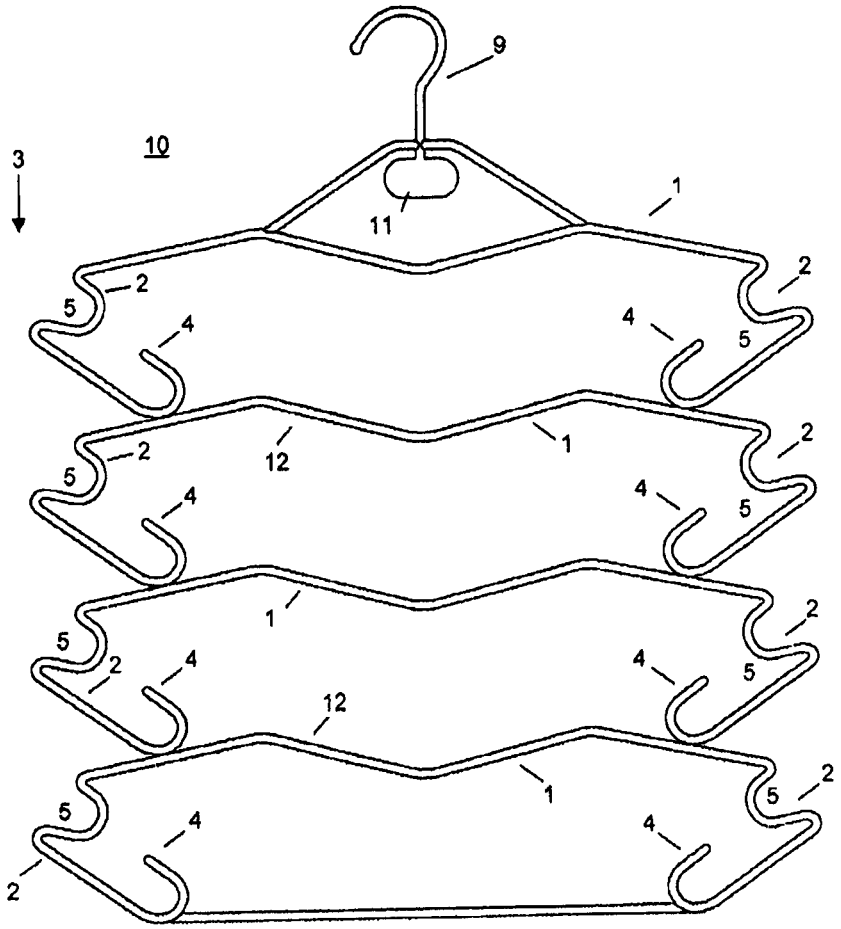
FIG. 1 illustrates a preferred embodiment of the present invention.

A preferred embodiment of the present invention comprises a multi rung hanger as shown in FIG. 1. The hanger 10 itself comprises at least one, preferably a plurality of rung members 1, which are connected to form the multi-runged device 10. The connection between rung members may be an integral formation or as in the case of wire a welding or solder connection.

Figure 5:
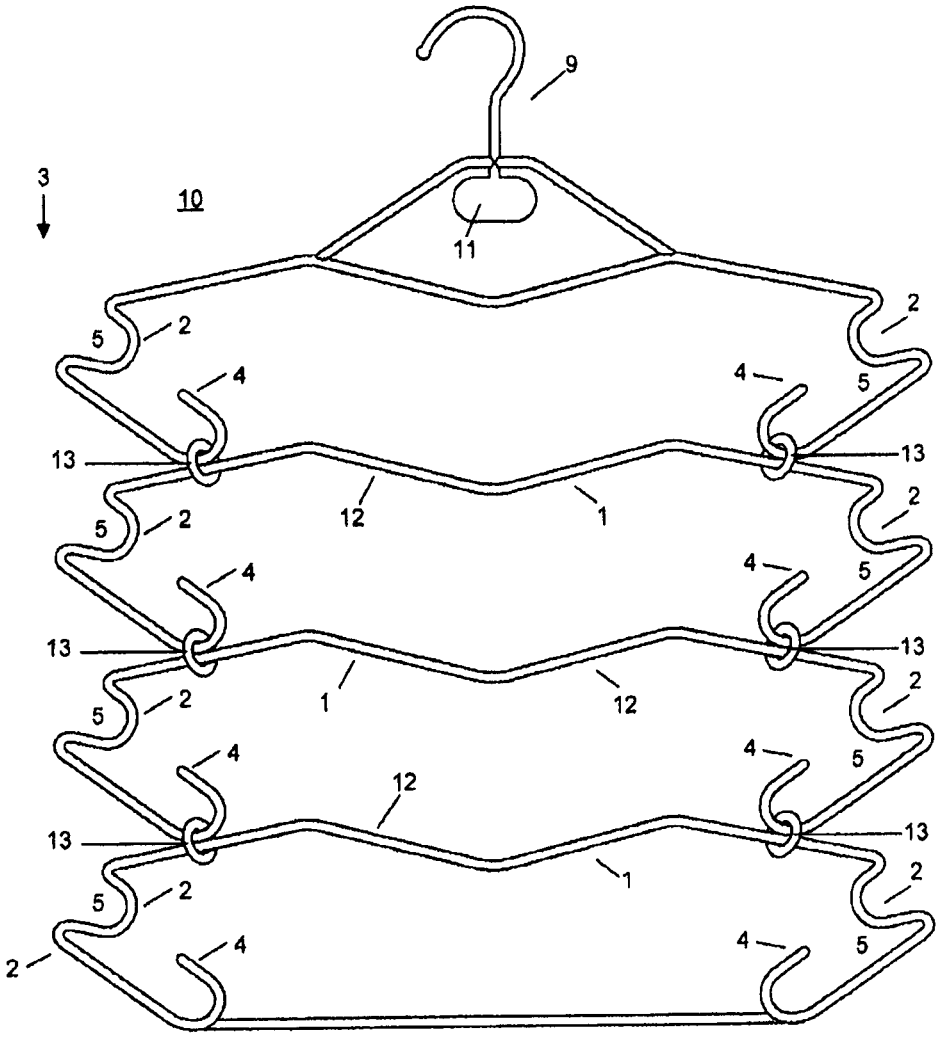
FIG. 5 shows an alternate embodiment of the present invention illustrating hinged connection between rung members.

Alternatively, as shown in FIG. 5, the connection between the rungs can be hinged via hinge means 13 to allow the unit to be folded up to a small and compact size.

First attachment formations 2 are disposed on the outer periphery 3 of the rung members 2. Second attachment formations 4 are disposed within the outer periphery 3 of the rung members.

Figure 2:
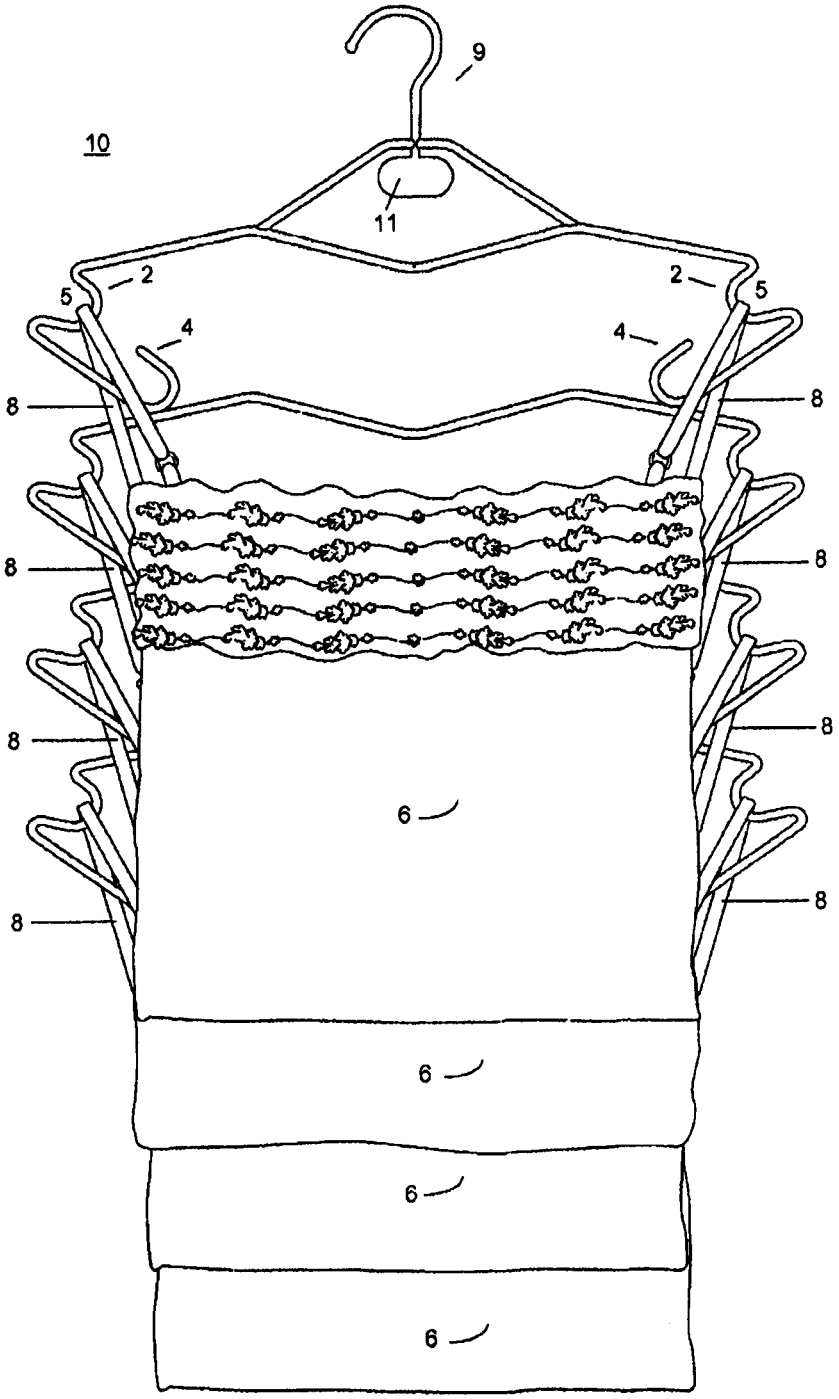
FIG. 2 shows the embodiment of FIG. 1 in use to store sleeveless garments.
Figure 3:
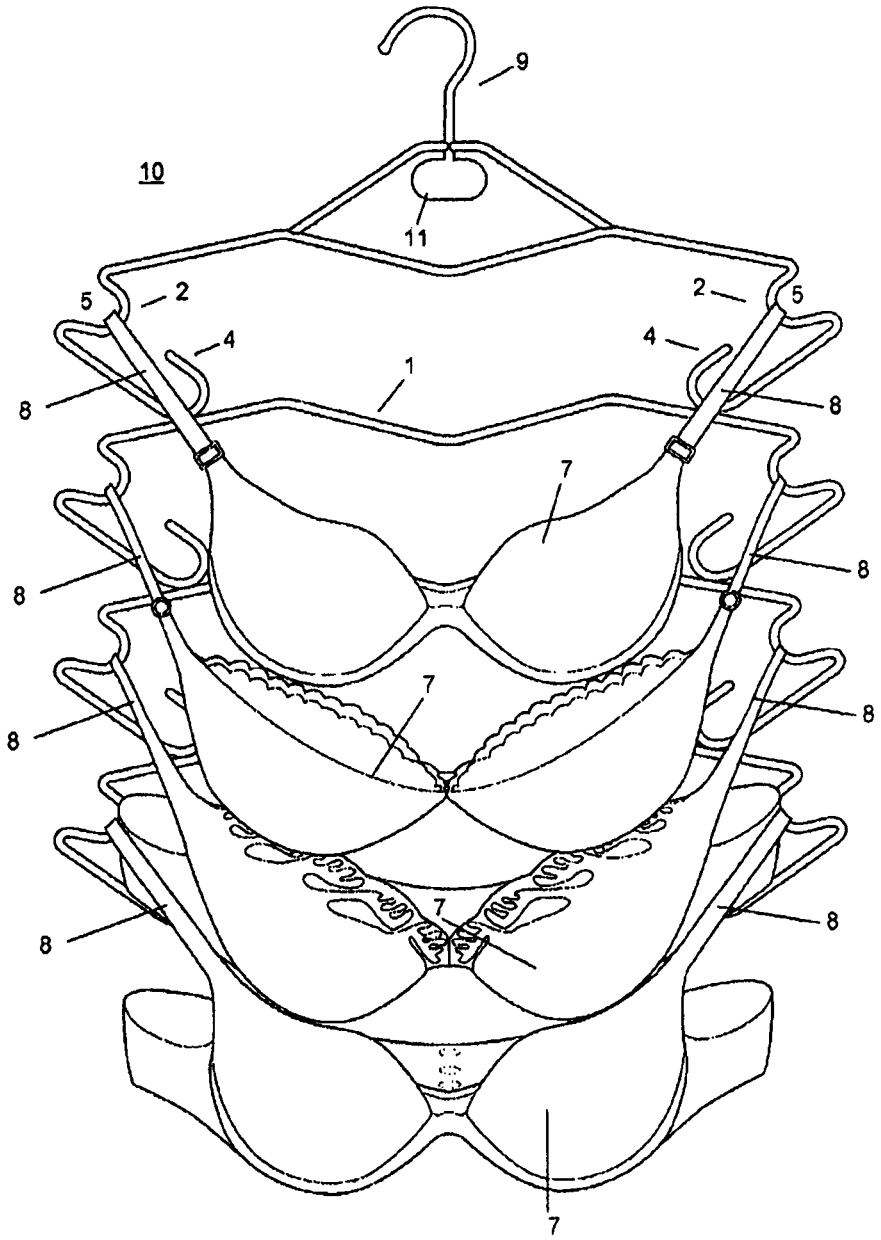
FIG. 3 shows the embodiment of FIG. 1 in use to store bras.

The first attachment formations 2 are shown in FIG. 1 to be in the form of loop means 5 and each pair of loop means 5 associated with each rung member is adapted to receive strap portions 8 of top garments such as the camisoles 6 shown in FIG. 2 or the bra garments 7 shown in FIG. 3.

Figure 4:
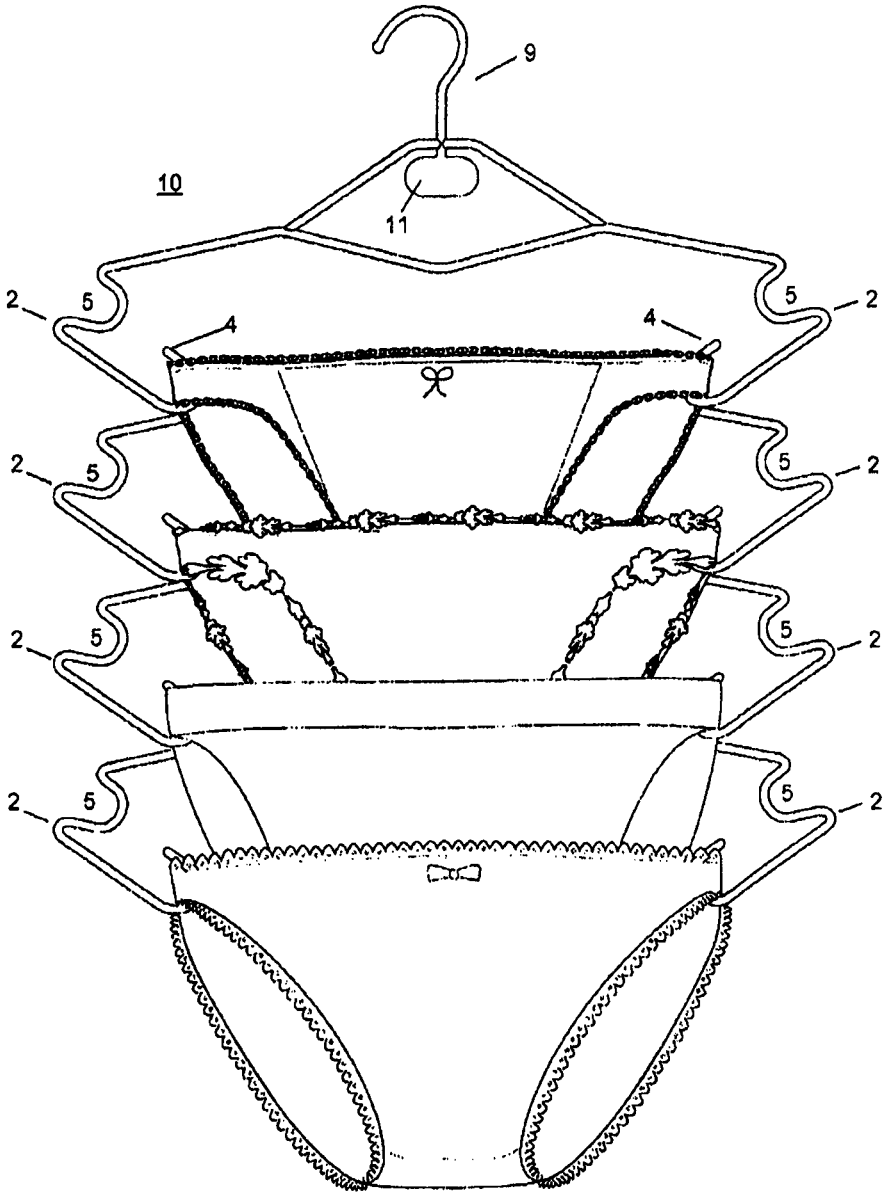
FIG. 4 shows the embodiment of FIG. 1 in use to store underwear panties.

The second attachment formations are shown in FIG. 1 to be in the form of hook means and each pair of hook means associated with each rung member is adapted to receive the waist portion of bottom garments such as the panties shown in FIG. 4. Other bottom garments may include, for example, bikini bottoms pants, other underwear bottoms and sleepwear bottoms.

It is to be appreciated that the attachment formations may comprise any combination of loop means, hoop means or hook means. Thus, for example in alternate embodiments, the first attachment formations may comprise hook means, the second attachment formations may comprise loop means or, both attachment formations may comprise one of hook or loop means. In alternate embodiments, the inventor has found that inner loops may also suit the cascade hanging of smaller sleeveless garments as well and not only the waist portion of a matching set of garments.

The attachment formations 2, 4, reside at the peripheral portions of the rung member 1 where the first attachment formations are located on the outer periphery and the second attachment formations are located within the outer periphery. Each rung member has a substantially horizontal strut 12 that connects the peripheral portions of each rung member. The strut has a slight wave formed in it, which serves to provide an aesthetic feature. Of course, in alternate embodiments, the strut 12 may also be straight without any deviation from horizontal, as it were.

In the embodiment shown in the figures each of the attachment formations lies in the plane of the rung member. In other embodiments it is envisaged that one or both of the attachment formations may lie outside the plane of the rung member.

The attachment formations as shown in the figures are preferably formed integrally with the rung member.

The hanger device preferably has the hook of a conventional hanger at its head 9 for the purpose of hanging the device from a rail, line, horizontal member; door or shower. The head 9 is also adapted to swivel. A display tag 11 may be attached to the head 9 for the purposes of display in a commercial environment or to assist with ordering of hangers on a rail.

Manufacture of the hanger device includes use of wire to form the device. Preferred steps of manufacture are:

The product of preferred embodiments is currently manufactured out of welded mild steel wire then plastic coated with a polypropylene finish. The wire finish can also be done with chrome, powder coating, plastic, flocking material or any other suitable coating as would be recognised by the person skilled in the art. The preferred product can also be made out of solid plastic mould via injection moulding, blow moulding or any other suitable plastic moulding process.

The product of a preferred embodiment is currently manufactured by creating the individual rungs out of a wire forming machine and then welding or hinging the parts together out of welded mild steel wire then plastic coated with a polypropylene finish. The wire finish can also be done with chrome, powder coating, plastic, flocking material or any other coating.

Alternatively, in a particular embodiment, a hanger may be manufactured such that the rungs are clipped together so that in a shop front display the hanger can be assembled to a preferred length simply by clipping more rungs to device. It is also envisaged that use of clips for adjoining rungs can facilitate folding of rungs to adjust the length of the hanger device.

It can also be made from solid plastic mould, bronze wire stainless steel and a multitude of other materials that would be recognised as suitable for hangers by the person skilled in the art bearing in mind the loading that may be required in a number of uses for each embodiment, such as for example, when hanging, storing and/or displaying multiple sets, of garments. For example, whilst it may not lend itself to the production efficiencies of metals or plastics, wood may be used for the manufacture of embodiments of the present invention as it has been traditionally used in conventional hangers.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

What is claimed is:

1. A garment hanger comprising a plurality of rung members, one or more of the plurality of rung members comprising a continuous length of material, the continuous length of material comprising a horizontal strut extending between first and second peripheral portions, each peripheral portion comprising:

first attachment formations disposed on the outer periphery of the rung member and adapted to receive a first portion of a first garment and;

second attachment formations disposed within the outer periphery of the rung member and adapted to receive a second portion of a second garment, wherein each of the second attachment formations comprises:

a hook comprising a first hook portion extending downward and inward from an outermost periphery of the respective peripheral portion to a lowermost portion of the rung member and a second hook portion extending upward from the lowermost portion of the rung member to a free end, wherein the lowermost portion of a first rung member of the plurality of rung members is connected to the horizontal strut of a lower rung member of the plurality of rung members.

2. A garment hanger as claimed in claim 1 wherein at least one of the attachment formations are disposed in the plane of the rung members.

3. A garment hanger as claimed in claim 1 wherein at least one of the attachment formations are disposed out of the plane of the rung members.

4. A garment hanger as claimed in claim 1 wherein the attachment formations are integrally formed with the rung member.

5. A garment hanger as claimed in claim 1 wherein adjacent rung members are integrally connected to each other.

6. A garment hanger as claimed in claim 1 wherein adjacent rung members are hingedly connected to each other.

7. A garment hanger as claimed in claim 1 wherein at least one of either the attachment formations or the rung members comprise a wire formation.

8. A garment hanger as claimed in claim 1 wherein the first attachment formations comprise one or a combination of:

loop means;

hook means.

9. A garment hanger as claimed in claim 1 wherein the first garment and the second garment are one and the same kind of garment.

10. A garment hanger as claimed in claim 1 wherein the first garment and the second garment are different garments together forming a set of garments.

11. A garment hanger as claimed in claim 1 wherein the first portion of a first garment comprises a strap portion of a sleeveless garment.

12. A garment hanger as claimed in claim 1 wherein the second portion of a second garment comprises a waist portion of one of:

panties;

a bikini bottom;

pants;

an underwear bottom;

a sleepwear bottom.

13. A garment hanger as claimed in claim 1 further comprising a supporting hook located on the topmost portion of the hanger for allowing the hanger to be hung from a supporting structure.

14. A garment hanger as claimed in claim 13 wherein the supporting hook is adapted to swivel for allowing the hanger to be turned up to at least 90 degrees with respect to the supporting hook whilst hanging from the supporting structure.

15. A method of manufacturing a garment hanger comprising the steps of:

forming a plurality of rung members, each rung member of the plurality of rung members being formed as a continuous length of material and comprising a horizontal strut extending between first and second peripheral portions;

machine forming first attachment formations in an outer periphery of the first and second peripheral portions;

machine forming second attachment formations internally of the outer periphery of the first and second peripheral portions, the second attachment formations comprising:

a hook comprising a first hook portion extending downward and inward from an outermost portion of the respective first and second peripheral portion to a lowermost portion of the respective rung member and a second hook portion extending upward from the lowermost portion of the respective rung member to a free end of the respective rung member;

connecting the lowermost portion of a first rung member of the plurality of rung members to the horizontal strut of a lower rung member of the plurality of rung members.

16. A method as claimed in claim 15 wherein the step of forming the plurality of rung members comprises wire forming.

17. A method as claimed in claim 15 further comprising the step of:

welding rung portions of rung members together to form integral connections therebetween.

18. A method as claimed in claim 15 further comprising the step of:

hinging rung portions of rung members together to form hinged connections therebetween.

* * * * *